United States Patent [19]

Boulier

[11] Patent Number: 4,622,764

[45] Date of Patent: Nov. 18, 1986

[54] SHOES WITH SUPPLE SOLES, NOTABLY SPORTS-SHOES

[75] Inventor: Maurice Boulier, Incarville Louviers, France

[73] Assignees: Societe Technisynthese Sarl, Saint Pierre Montlimart; Sarl Chaussures Labelle, Saint Pierre du Vauvray, both of France

[21] Appl. No.: 670,921

[22] Filed: Nov. 13, 1984

[30] Foreign Application Priority Data

Nov. 14, 1983 [FR] France ..... 83 18031

[51] Int. Cl.[4] ..... A43B 23/08

[52] U.S. Cl. ..... 36/68; 36/69

[58] Field of Search ..... 36/68, 69

[56] References Cited

U.S. PATENT DOCUMENTS

| | | | |
|---|---|---|---|
| 485,604 | 11/1892 | Brazier | 36/68 |
| 1,283,783 | 11/1918 | Ingleman | 36/68 |
| 1,575,466 | 3/1926 | Tyler | 36/68 |
| 2,456,102 | 12/1948 | Agostinelli | 36/68 |
| 2,483,520 | 10/1949 | Blake | 36/68 |
| 4,255,877 | 3/1981 | Bowerman | 36/69 |
| 4,287,675 | 9/1981 | Norton et al. | 36/68 |
| 4,510,701 | 4/1985 | Schour et al. | 36/69 |

FOREIGN PATENT DOCUMENTS

| | | | |
|---|---|---|---|
| 1075013 | 4/1960 | Fed. Rep. of Germany | 36/68 |
| 1515419 | 3/1968 | France | 36/68 |
| 2208279 | 6/1974 | France . | |
| 1104296 | 11/1985 | France | 16/4 |
| 3342422 | 8/1984 | Japan | 36/69 |

*Primary Examiner*—Werner H. Schroeder
*Assistant Examiner*—Mary A. Ellis
*Attorney, Agent, or Firm*—Young & Thompson

[57] ABSTRACT

The present invention relates to a shoe with a supple sole, notably a sports-shoe which comprises, incorporated in at least the portion of the uppers (18) corresponding to the calcaneum and the astragalus which are enclosed therein, a molded shell (9) extending at least underneath the heel up to the level of the plantar arch, and which is rigidly connected via its lower portion (13) to the thick molded sole (20) made of a supple material, preferably by anchoring structure such as studs (21).

4 Claims, 10 Drawing Figures

SHOES WITH SUPPLE SOLES, NOTABLY SPORTS-SHOES

TECHNICAL FIELD

The present invention relates to the structure of the shoes comprising a relatively thick supple sole, and notably sports-shoes, and its object is to provide in such shoes, notwithstanding the suppleness and deformability of the sole and possibly of the material constituent of the uppers, a perfect hold of the foot. The aim pursued is to provide a perfect stabilization of the foot during the movements inherent to the practice of some sports in order to avoid accidents to the joints such as sprains, wrenches and articular inflammations of the ankles, the knees, etc.

BACKGROUND OF PRIOR-ART

It is usual to reinforce the rear portion of the uppers by a reinforcement of the heel called "stiffener" or "counter", in a material more rigid than the uppers, added outside or incorporated in the layer of materials constituent of said uppers and rigidly connected by a lower turned-in edge to the material constituent of the sole, said counter enclosing laterally the calcaneum and the astragalus.

It has also been proposed in FR-A-2 208 279 to provide a shoe with high uppers by starting from a two part blank, the part forming the relatively rigid lower base comprising a sole, a rear counter and a heel and at least a throughgoing hole, and by over-molding on the two assembled parts of the blank a layer of plastic material providing the connection. The layer of more flexible plastic material coating the uppers and the base is of reduced thickness and such a shoe cannot be used as a sports-shoe for practicing sports such as foot-race, tennis, jogging, etc., for the practice of which the supple sole must have a substantial thickness for absorbing the impacts.

DISCLOSURE OF INVENTION

The present invention is characterized in that there is incorporated in at least the portion of the uppers corresponding to the calcaneum and the astragalus which are enclosed therein, a molded shell extending at least underneath the heel up to the level of the plantar arch, and which is rigidly connected via its lower portion to the thick molded sole made of a supple material.

The shell is preferably molded from a rigid material in order to form a rigid frame which can extend up to the falangeal-metatarsal joint. It can also be combined with a front shell forming the hard tip and a support for the phalangeal under-face, the two shells being rigidly connected via an articulation formed by the sole made of a supple material.

The rigid connection between the molded shell and the sole can be provided when molding the sole, when the two constituent materials are compatible and can be stuck-on to each other with or without an intermediate medium, or by gluing a pre-fabricated sole. However and preferably, in order to resist securely the intense stresses to which the shoe is subjected, the connection is mechanically reinforced by anchoring elements and/or by means of portions fitting into each other. The anchoring elements can be formed by protrusions and/or recesses on or in the surface of the shell, in contact with the mass of the sole. The protrusions and/or recesses have preferably in their surface lateral protrusions and/or grooves for improving the bonding of the sole onto the shell.

According to an embodiment, a junction per parts fitting into each other is provided by a peripheral edge of the shell extending downwardly and surrounding the upper portion of the sole. The interest of such an embodiment is to avoid or at least reduce the peripheral swelling appearing when there is a compression of the elastomer forming the supple sole and the resulting rolling tendency. The inner face of the edge extending downwardly can also be formed with protrusions or recesses in order to improve the anchoring. Surprisingly, this arrangement provides the stability of a non compressible and rigid sole and the deformability of a sole made of a cellular material.

The molded shell can include lightened portions possibly forming ventilation orifices and said lightening devices can be provided in the side portions as well as in the portion in contact with the sole.

The shell can be incorporated in the uppers between the outer surface of the uppers and the lining, with the reserve that its lower surface remains rigidly connected to the sole, but it can also form the visible surface of a portion of the uppers, notably of the portion corresponding to the heel-piece. The connection between the shell and the uppers can be performed by gluing, stitching when at least the portion of the shell where the stitching is made can be punched by the needle, or by a simple sheathing.

Still with the object of improving the hold of the foot in the shoe, openings can be formed in the side walls of the shell, allowing the passage of setting straps attached to a fixation element rigidly connected to the upper, said device being independent of the traditional closing system or lacing.

BRIEF DESCRIPTION OF DRAWINGS

Some embodiments of a shoe reinforcing shell according to the invention will be described hereafter, with reference to the accompanying drawings wherein.

DETAILED DESCRIPTION OF INVENTION

The embodiments described are only intended to illustrate and make the invention better understandable, and can be modified so as to be used in pratice, notably as regards demolding problems of the reinforcement shell, the assembly of the uppers, the lightening of the molded shell, etc., all these problems being within the normal competence of those skilled in the art.

The shells of FIGS. 1 through 6 are made of a cup-shaped molded part surrounding the heel by a rear peripheral wall 1 and a lower wall 2 extending frontwardly to underneath the metatarsal region. The shell can be made of a rigid or relatively rigid material such as polystyrene, polyurethane, polyethylene, thermoplastic rubber, etc., and even a light metal or embossed leather.

Figure 1:
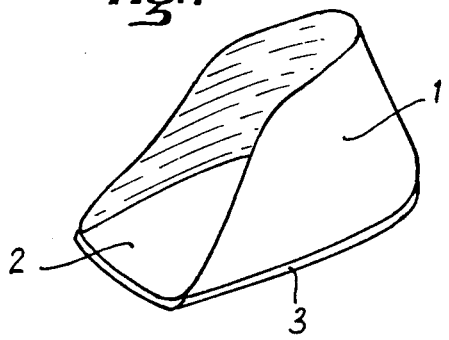
FIG. 1 is a perspective view of a shell which can be rigidly connected to the sole by sticking.

The shell of FIG. 1 is provided for being rigidly connected to the sole on all the surface of pad 3 which is made of a material compatible with the supple material forming the sole, for example a cellular material.

Figure 2:
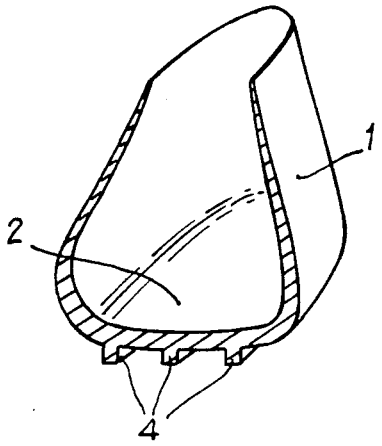
FIGS. 2 through 5 are views in perspective and partial cross-section of shells comprising anchoring elements formed by protrusions.
Figure 3:
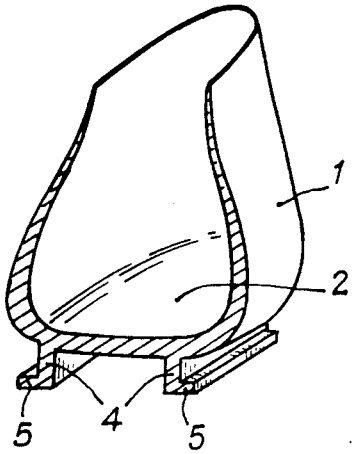
Figure 4:
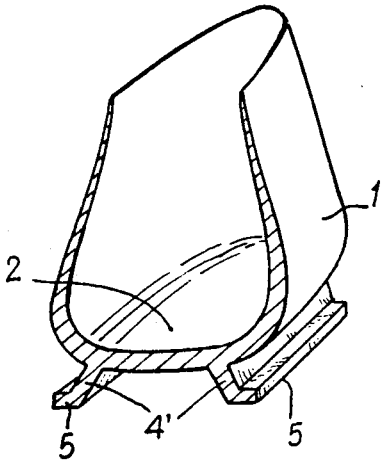

In the shell of FIG. 2, the anchoring which is also obtained by sticking the lower face with the material constituent of the sole is improved by longitudinal ribs 4 which increase the connection surface and resist mechanically side efforts exerted between the sole and the upper portion formed by the shell and the uppers. In the embodiment of FIGS. 3 and 4, the anchoring is improved by the fact that the longitudinal ribs, which are perpendicular to pad 2 (4, FIG. 3), or diverging from said pad (4', FIG. 4) have ribs 5 protruding sideways and improving the anchoring.

Figure 5:
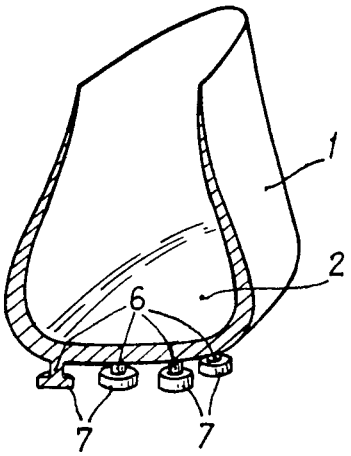
Figure 6:
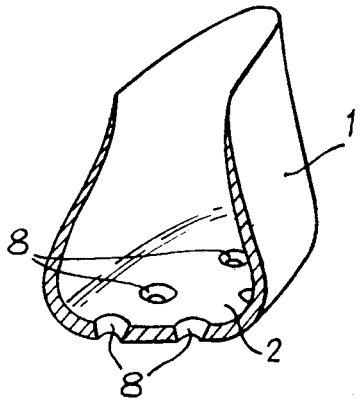
FIG. 6 is a view in perspective and partial cross-section of a shell comprising anchoring elements formed by recesses.

In the shell of FIG. 5, the mechanical anchoring is provided by cylindrical studs 6 ending in enlarged heads. On the contrary, the shell of FIG. 6 is formed in pad 2 with frustoconical orifices 8 flaring out in the direction of the inside of the shoe, orifices into which penetrates, when molding the sole, the material constituent of the latter and which is to form the connection rivets.

Figure 7:
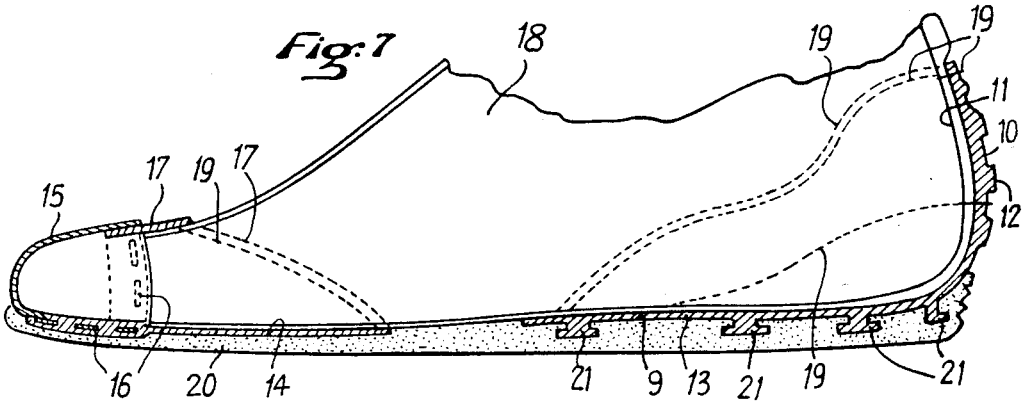
FIG. 7 is a axial cross-sectional view of a shoe associating a heel shell to a front shell and a hard tip.

In FIG. 7, the shell which is designated as a whole by reference 9 comprises a rear peripheral wall 10 surrounding the heel portion outside the heel-piece 11 of the uppers. The peripheral wall has stiffening ribs 12 providing also a protection against impacts. The lower wall 13 of the shell heel cup extends underneath the plantar arch. The shoe comprises on the other hand a front shell 14 rigidly connected via its front portion to a rigid hard tip 15 anchored via openings 16 in the shell material forming also a strap 17 on the front of the foot.

The shells are rigidly connected to the uppers 18 by stitches 19 distributed on the superimposed surfaces, or by gluing or sticking. A sole 20, for example made of a micro-cellular plastic material, is then molded in known manner on the assembly formed by the shell and the uppers. The shell has on its lower surface elements intended to be incorporated during the molding in sole 20, such as connection studs 21.

Figure 8:
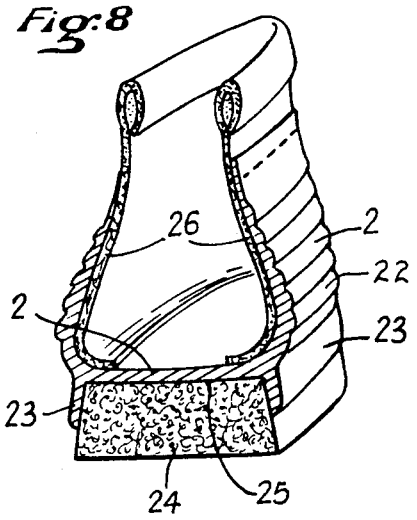
FIG. 8 is a transverse cross-sectional view of a shoe with a shell surrounding the upper portion of the sole.

Shell 22 of FIG. 8 has a peripheral edge 23 extending downwardly and forming a cup in which is fitted the upper portion of sole 24. Sole 24 can be pre-molded or glued in position when the inner surface 25 of the cup formed by the lower face of pad 2 and the inner face of the edge extending downwardly is smooth and it is molded in position when said surface 25 is formed with anchoring elements. Preferably and in such a case, the sole is made of a very supple material such as a microcellular rubber, the stability being nevertheless perfect due to the blocking of the sole inside the cup. The uppers 26 are fitted into the shell 22.

Figure 9:
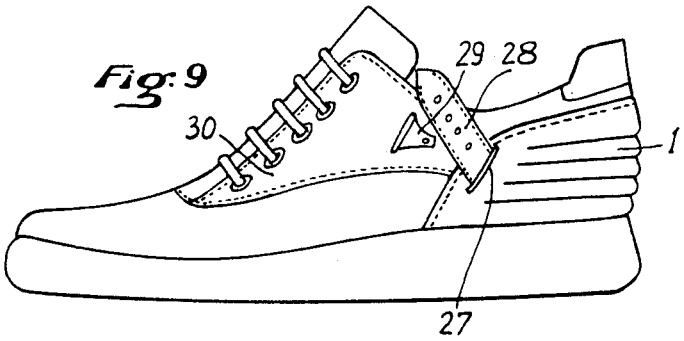
FIG. 9 is an elevation view of a shoe with settable clamping members between the uppers and the shell.

In the shoe shown in FIG. 9, the shell 1 is outside the uppers. For setting and clamping the foot in shell 1, an opening 27 is provided near the edge of the shell, through which extends a setting strap 28 which can be attached to a fixation element 29 rigidly connected to the upper 30. Such a device independent of the traditional closing and lacing system can be provided on either side of the shoe, whereby the two straps 28 can be connected in front of the instep.

Figure 10:
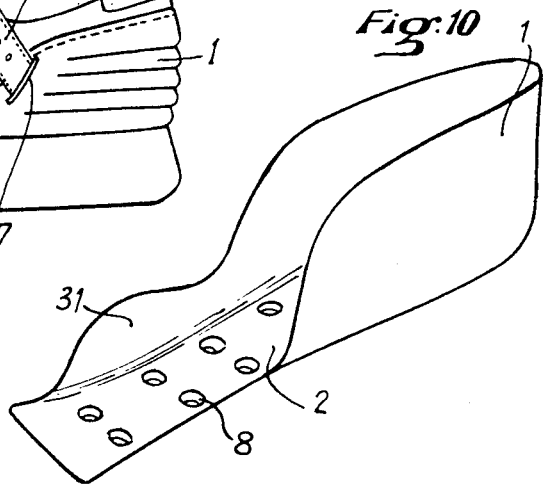
FIG. 10 is a perspective view of another type of shell.

In FIG. 10, pad 2 of the shell, provided with anchoring means such as perforations 8, extends up to the metatarsal joint and comprises on the inner side a support pad 31 for the plantar arch.

I claim:

1. A shoe comprising a molded shell extending at least underneath the heel of the wearer up to the level of the plantar arch of the wearer, said molded shell being incorporated in an upper of the shoe with its lower surface in direct contact with the upper surface of a sole of the shoe made of an injection molded plastic material, said shell comprising a peripheral edge extending downwardly of said lower surface of the shell, said peripheral edge surrounding and contacting the side walls of the upper portion of the injection molded sole which supports said upper surface.

2. A shoe comprising a molded shell extending at least underneath the heel of the wearer up to the level of the plantar arch of the wearer, said molded shell being incorporated in an upper of the shoe with its lower surface in direct contact with the upper surface of a sole of the shoe made of an injection molded plastic material, and a connection between the lower surface of the shell and the molded shoe including anchoring elements provided in the surface of the shell and comprised by the material of the shell in contact with the molded material of the sole, said anchoring elements being protrusion that extend downwardly from the shell.

3. A shoe according to claim 2, in which the lateral surfaces of said protrusions comprise recesses for improving the bonding of the sole onto the shell.

4. A shoe comprising a molded shell extending at least underneath the heel of the wearer up to the level of the plantar arch of the wearer, said molded shell being incorporated in an upper of the shoe with its lower surface in direct contact with the upper surface of a sole of the shoe made of an injection molded plastic material, and a connection between the lower surface of the shell and the molded shoe including anchoring elements provided in the surface of the shell and comprised by the material of the shell in contact with the molded material of the sole, saids anchoring elements being recesses into which the molded material of the sole extends upwardly.

* * * * *